United States Patent [19]

Tong

[11] 4,432,511

[45] Feb. 21, 1984

[54] BEAM-RIDER GUIDANCE USING TWO OVERLAPPING RETICLE DISCS

[75] Inventor: Kay C. Tong, Mission Viejo, Calif.

[73] Assignee: Northrop Corporation, Hawthorne, Calif.

[21] Appl. No.: 262,684

[22] Filed: May 11, 1981

[51] Int. Cl.[3] ..... F41G 7/26

[52] U.S. Cl. ..... 244/3.13

[58] Field of Search ..... 244/3.13; 250/203 R

[56] References Cited

U.S. PATENT DOCUMENTS

| | | | |
|---|---|---|---|
| 2,404,942 | 7/1946 | Bedford | 244/3.13 |
| 3,690,594 | 9/1972 | Menke | 244/3.13 |
| 3,950,099 | 4/1976 | Malueg | 250/203 R |
| 4,014,482 | 3/1977 | Esker et al. | 244/3.13 |
| 4,174,818 | 11/1979 | Glenn | 244/3.13 |
| 4,245,156 | 1/1981 | Harvey et al. | 250/203 R |

FOREIGN PATENT DOCUMENTS

| | | | |
|---|---|---|---|
| 1292509 | 4/1969 | Fed. Rep. of Germany | 244/3.13 |

*Primary Examiner*—Charles T. Jordan

*Attorney, Agent, or Firm*—William W. Rundle; Robert J. Stern; John E. Peele, Jr.

[57] ABSTRACT

A beam rider guidance concept and transmitting assembly including two synchronously rotating discs with beam modulation patterns thereof positioned such that the modulation pattern on one disc passes through the centerline of the projected guidance beam in the elevation direction and the modulation pattern on the other disc passes through the beam in the azimuth direction. The discs are closely adjacent, and have clear reticles or spaces included to allow uninhibited beam passage where necessary. Where other clear reticles or spaces appear in both discs simultaneously, various digital on-off light signals are sent to a receiver in the guided projectile or projectiles, to perform functions of synchronization, calibration, and address codes and bias guidance position codes applicable to a plurality of simultaneously guided missiles or objects directed to individual respective targets.

The guidance beam is a pulsed laser, for example, having electronic pulsing control and also pulse timing dependent upon disc position pick-off means. The pulse control may be delayed slightly on predetermined successive revolutions to provide a greater resolution of guidance position control.

18 Claims, 6 Drawing Figures

BEAM-RIDER GUIDANCE USING TWO OVERLAPPING RETICLE DISCS

BACKGROUND OF THE INVENTION

1. Field of the Invention

The present invention relates to beam guidance systems for projectiles and the like, and, more particularly, to a beam modulating device for coding the projected beam with information enabling a receiver in the projectile to determine what the position of the projectile is in the beam cross section.

2. Description of the Prior Art

In this type of system, a spatially coded beam of electromagnetic energy, such as a laser, is received and read by a rearward facing receiver in a projectile during its flight to the target. Basically, the beam is pointed at the target from a projectile launching position, and a projectile flight control system uses the detected beam information to direct the projectile along the centerline of the beam. The launching site may be on an aircraft, on land or on sea, for example. Some systems, such as the present one, provide the projectile position information in the form of two directional signals—namely, an elevation signal and an azimuth signal.

Several such guidance schemes have been proposed and tested using a rotating disc in the path of the beam, the disc containing a particular pattern of light-passing and light-blocking portions which, together with stored or received reference information, will enable the receiver to tell at which fraction of the horizontal field or vertical field it may be located at that instant. Generally two such beams or discs are required, one for each flight control axis of the projectile.

The usual known systems are not adapted to the simultaneous control of multiple missiles against multiple targets. Further, many present systems are seriously affected by environmental light conditions including smoke, dust, or turbulence, in the intervening atmosphere. Others use impractical or complex modulation and/or decoding schemes.

U.S. Pat. No. 4,014,482 to Esker et al discloses a laser beam rider missile director using a rotating light chopper or reticle with opaque and transparent bar portions for coding the beam. The reticle has a center which is rotated around the center of the transmitted beam. The beam is pulsed at two different rates and coordinated with the reticle position to provide the missile receiver with magnitude and phase components to use in determining the missile position with respect to the beam centerline.

U.S. Pat. No. 2,942,118 to Gedance discloses a tracking system similar in general concept to the Esker et al system, that is, a patterned reticle wheel has an axis which is displaced from and rotates around the optical axis or centerline of the radiant energy beam.

U.S. Pat. No. 3,513,315 to Sundstrom et al uses a reticle pattern which nutates a beam of light about the line of sight without rotating about its own axis.

U.S. Pat. No. 4,178,505 to Skagerlund discloses a tracking device with a rotating mask having a modified radial type of light-forming pattern, used to measure target position in polar coordinates.

U.S. Pat. No. 3,950,099 to Malueg discloses a two-axis "motion detector" having a single rotating disc with two patterns thereon, for modulating a beam at two different frequencies.

U.S. Pat. No. 3,957,377 to Hutchinson discloses a position sensing arrangement of two beam signal patterns in a disc, utilizing a varying cross-section area of the beam.

U.S. Pat. No. 4,186,899 to Stewart discloses an oscillating mirror and chopper arrangement for projecting two rectangular beams in respective horizontal and vertical scanning directions.

While it is possible that more pertinent prior art exists, Applicant's search is believed to have been conducted with a conscientious effort to locate and evaluate the most relevant art available at the time, but this statement is not be be construed as a representation that no more pertinent art exists.

SUMMARY OF THE INVENTION

It is an object of the present invention to provide a beam rider guidance system which projects only one beam yet conveys coded signals in two directions or coordinates to thereby enable complete directional control of a missile receiving the beam.

A further object of this invention is to provide a beam rider guidance system in which operation is not defeated by variable environmental air conditions such as fog, patches of smoke, clouds of dust or the like.

It is another object of the present invention to provide a beam rider guidance system which is applicable to a single missile or to a plurality of missiles against different respective targets.

Briefly, my invention comprises a beam projector assembly including a pair of synchronized discs rotating on centers so positioned that an annular pattern of coded reticles on one disc passes vertically through the beam centerline and a similar pattern on the other disc passes horizontally through the beam centerline, adjacent to the first disc. The beam passes through both discs simultaneously, with spaced elevation modulation signals from the coded recticles on one disc alternating with spaced azimuth modulation signals from the coded reticles on the other disc.

In certain positions between the spaced modulation signal reticles, the discs are completely light transmitting, to allow the full cross section of the beam to pass for use as an intensity calibration signal. In certain other remaining reticle positions of the discs, respective on-off beam signals can be projected to serve as digital signals for each of several missiles being guided to different targets at the same time.

The remainder of the projector assembly comprises a pulse control for the radiating beam, with synchronizing pulse means sensed from the disc position.

This invention may include a pattern of modulation signals which gives the desired resolution of guidance accuracy with each revolution of the discs, or the complete cycle of position locating signals may be designed to require two or more disc revolutions, with the guidance pulses being fractionally delayed on the later revolutions to effectively project a greater number of signals.

DESCRIPTION OF THE PREFERRED EMBODIMENT

Figure 1:
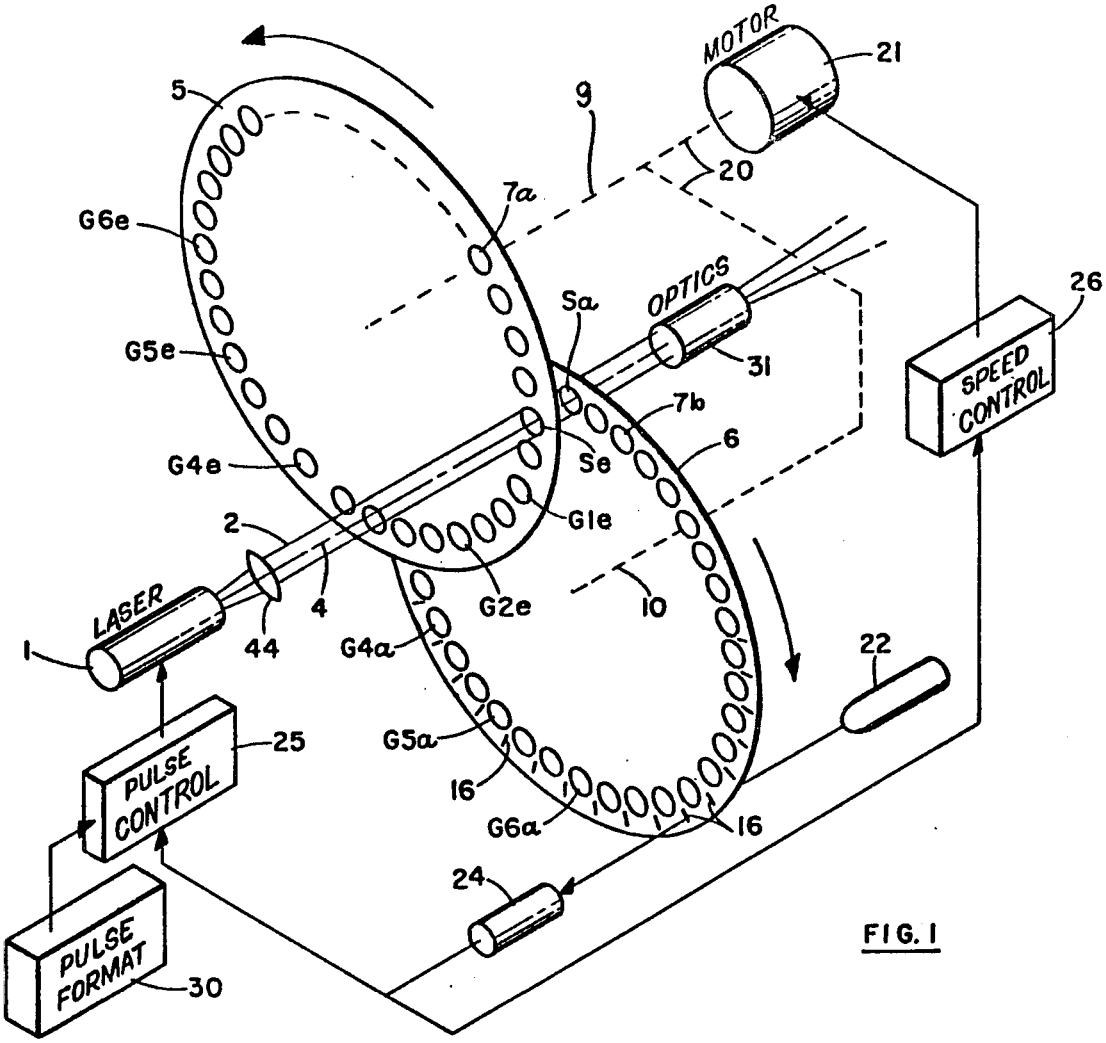
FIG. 1 is a pictorial diagram showing, in perspective and block form, a preferred overall arrangement of the present beam rider guidance system.

Referring first to FIG. 1 for a detailed description of a preferred guidance system embodying this invention, a pulsed laser 1 emits a beam 2 along a beam centerline 4. The laser is of any suitable type, and for airborne rocket guidance, it can be a $CO_2$ laser of about 150 watts peak pulse power at the beam center, for example. The beam 2 is spatially modulated as governed by two adjacent rotating discs 5 and 6 placed in the beam path. As shown, each disc has a circular pattern of 36, for example, reticles *7a* or *7b* near its rim. One disc, termed the elevation guidance disc 5, is rotatably mounted on an elevation disc axis 9 parallel to the laser beam centerline 4 and positioned so that the elevation disc reticles *7a* thereon pass vertically through the laser beam 2 as the disc 5 rotates, moving from below the beam to above, for example. The other disc, termed the azimuth guidance disc 6, is rotatably mounted on an azimuth disc axis 10 parallel to the laser beam and positioned so that the azimuth reticles *7b* thereon pass horizontally through the laser beam 2 as the disc 6 rotates, moving from the left side of the beam to the right side, for example. The discs are mounted closely adjacent to each other, as shown.

Figure 2:
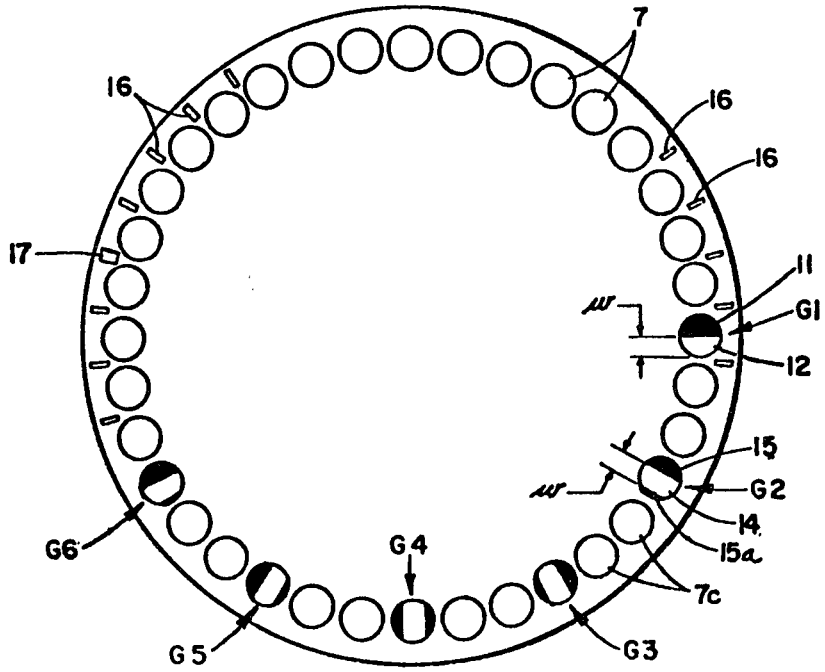
FIG. 2 is a face view of one of the two identical reticle discs of FIG. 1, showing a preferred reticle pattern.

Each of the discs 5 and 6 may have an identical reticle pattern, and one disc pattern is shown in detail in FIG. 2. Here, the 36 reticles 7 are equally spaced from each other and are all circular in shape, for simplicity of understanding. Except as will be mentioned, the disc is opaque to the laser beam.

There are six guidance reticles G1 through G6, each comprised of a light-passing portion and a light-blocking portion, with these portions at relatively different positions in the reticle. In guidance reticle G1, the upper portion 11 is light-blocking while the lower portion 12 is completely light-passing (light transmissive).

In guidance reticle G2, the light-passing portion 14 is effectively shifted upward a fraction while still retaining the same width w as in G1. In other words, the light-blocking portion 15 of G2 is slightly narrower than its counterpart in G1, and a small second light-blocking area 15*a* of G2 has been added. This pattern shifting is continued proportionately for guidance reticles G3 through G6. It can thus be seen that when the disc in FIG. 2 is put into the place of the elevation guidance disc 5 of FIG. 1 and revolved counterclockwise, the positions of the beam portions projected through G1, G2, G3, etc., will be sequentially raised. The pulsed projected beam portions through the guidance reticles G1 through G6 are bars of transmitted light of constant width w in the vertical direction (for the elevation disc) but at different sequential vertical positions in the vertical plane.

As the disc 5 is rotated from G1 through G6, it will be seen that the projected laser beam bar progresses or scans from a position at the lower portion of the reticle *7a* to a position substantially at the upper portion.

In this pattern, there are two completely clear or light-transmissive reticles *7c* between guidance reticles G1 and G2. There are also two completely light-transmissive reticles between each successive two guidance reticles. After guidance reticle G6, all remaining reticles 7 are also perfectly light-transmissive.

As will be described later, whenever the laser beam 2 is shining through a guidance reticle G1, etc., in one disc, the other disc must have a completely clear reticle opposite, at the same time. That is the purpose for many of the clear reticles in the group.

At least one of the two discs 5 and 6 is also provided with a series of trigger timing slots 16, one for each reticle at most, which may be small, accurately spaced openings located in fixed position relationship to the reticles, between the reticles 7 and the periphery of the disc, for example. The trigger slots 16 are for laser pulse control purposes and will be referred to later. One of the trigger slots is widened or otherwise made to have a slightly advanced leading opening located closer than normal to its preceding trigger slot. The advanced slot is a synchronizing pulse slot 17, located as shown in FIG. 2 for example. The purpose and operation of this synchronizing slot 17 will be described later.

The two discs 5 and 6 are relatively connected and driven in a 1:1 ratio by gearing represented in FIG. 1 by dashed lines 20, in turn driven by a motor 21. The discs 5 and 6 are relatively geared or indexed so that one respective reticle position on each disc is coincident with the laser beam position simultaneously. In other words, as illustrated in FIG. 1, the laser beam 2 can shine through both discs at each respective adjacent reticle position. As will be described later, the laser beam is nominally given a short "on" pulse at each reticle position, except where it may remain "off" as a "zero" digit in a binary number.

As further shown in FIG. 1, laser pulse timing is provided by timing slot detecting means such as a small light source 22 and a light detector 24 placed on opposite sides of azimuth guidance disc 6, for example, in position to shine through the timing slots 16 as disc 6 rotates. The light detector 24 is a transducer generating an electrical pulse for each reticle position, as will be understood. The light source 22 and detector 24 are of course located at a proper angular position circumferentially of the disc 6.

The output pulses from light detector 24 are fed to a laser pulse control 25 and also to a motor speed control 26 in a servo loop with the motor 21.

Two identical discs are shown in FIG. 2 may be used for the system of FIG. 1. The elevation disc 5 in FIG. 1 is taken from the disc as shown in FIG. 2, and rotated counterclockwise. The azimuth disc 6 in FIG. 1 is an identical disc as shown in FIG. 2, only turned over front-to-back and rotated clockwise by gearing 20, i.e., counter-rotating relative to the elevation disc 5.

Figure 3:
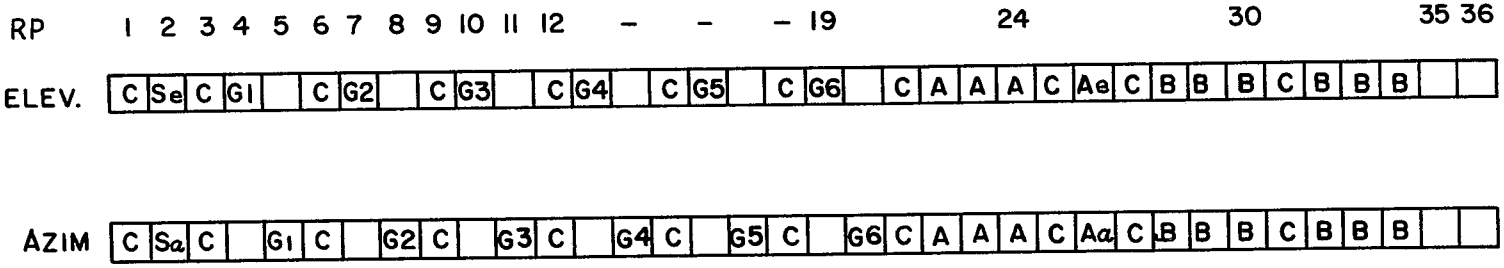
FIG. 3 is a chart identifying the function of each of the 36 reticle positions in the two discs, the positions being aligned one above another as they appear together at the beam centerline during operation.

The relative positions which the discs 5 and 6 are indexed in are shown in FIG. 3. This diagram shows all 36 reticle positions RP1 through RP36 of the two discs 5 and 6. Each reticle position of one disc is identified and shown in vertical alignment over (or under) the corresponding recticle position of the other disc with which it will be paired in the beam. The discs in FIG. 1 are shown in reticle position RP2, where synchronizing pulse reticle Se in elevation disc 5 is time-coincident in the beam with synchronizing pulse reticle Sa in azimuth disc 6. When the equipment is rotated in position RP4, for instance, FIG. 3 shows that elevation guidance reticle G1 (G1e in disc 5 of FIG. 1) will be paired with a blank or clear reticle in azimuth disc 6.

The reticle positions marked C in FIG. 3 are termed calibration reticles and are perfectly clear or open. Note that the calibration reticles C are always aligned opposite another C reticle in the other disc, so that the laser beam at this time will be at full intensity. This is an important feature of the present invention. The receiver in the missile or other vehicle to be guided by the laser beam 2 will use the calibration pulses to determine the variable setting of a threshold circuit from which to determine whether to count a particular received light signal as a "pulse" or "no pulse". This allows the system to operate accurately in a changing atmospheric environment and projector to receiver distance. In other words, intermittent clouds, dust, or variable brightness background caused by other conditions will not adversely affect the operating accuracy caused by incorrectly received signals. For example, the threshold value may automatically follow one-half the intensity of brightness of the calibration pulses being currently received.

Without going into detail at the present time, it will be seen that the beam receiving equipment in the guided vehicle or projectile will contain equipment performing the functions of clock generator, synchronizing pulse detector, counters, code sorters and the like to separate and operate on the light signals received in the respective time slots of the numbered reticle positions RP1–RP36. For instance, the digital signal received in reticle positions RP5, 8, 11, 14, 17 and 20 will always be a six-bit binary word or part thereof designating the missile azimuth position in the laser beam cross section. Further description of reticle positions in FIG. 3 will be given later.

At this stage, it is seen that one revolution of the discs 5 and 6 will serve to coarsely locate the guided projectile, i.e., inform it of its position relative to the beam centerline. With the guidance reticle bars G1–G6 as designed in FIG. 2, it can be seen that a resulting six-bit binary position signal is received in the projectile, and the position of the guided projectile will be known to a resolution of only one of eleven possible positions or zones in the field (for each coordinate elevation and azimuth direction of course). Now the resolution can be greatly increased by "time sequencing" in the subsequent disc rotation(s), as shown in the following description.

The higher resolution system may be arranged to formulate a complete guidance location only after two or more revolutions of the discs. During the first revolution, the action will be as described in the preceding paragraph. In the second revolution, the same guidance reticles G1 through G6 (in each of the two discs) are used except that for this revolution, the laser beam is pulsed with a slight time delay, controlled electronically by the laser pulse control 25. This allows the bar pattern in the guidance reticles to advance somewhat farther along each of their directions of travel resulting in a small displacement of the projected beam modulation signal received at the guided vehicle, as compared to the projected beam signal during the first revolution. In the present system example, five revolutions are used to develop a full cycle, the laser guidance pulses being progressively delayed longer for the third, fourth and fifth revolutions. In this way, the guidance reticles G1–G6, over a five-revolution interval, give a 30-bit position signal resulting in a resolution of one in fifty-nine increments of space or position, arranged to be divided equally across the field of view of the beam.

Figure 4:
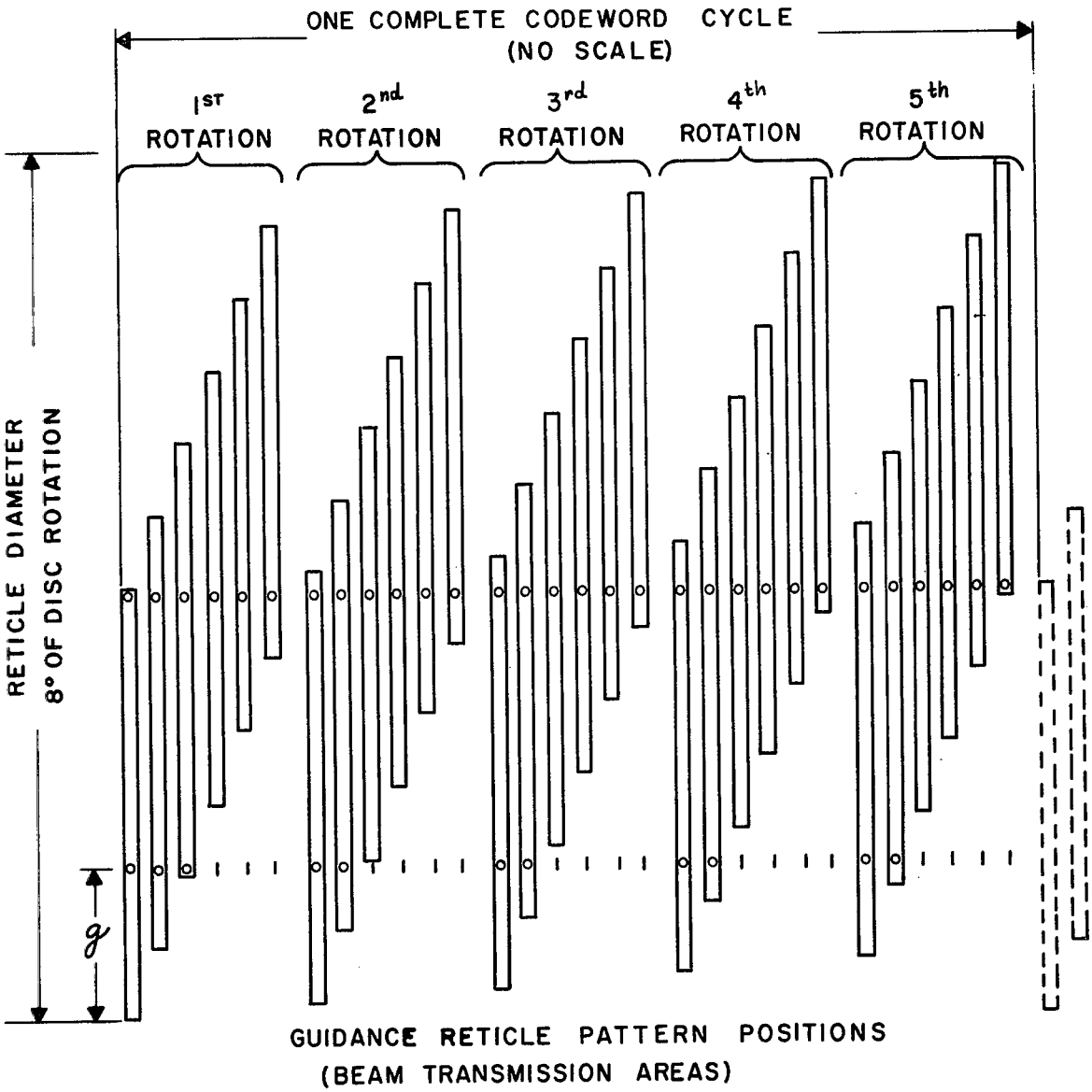
FIG. 4 is a chart illustrating the sequential positions of the modulated guidance beam produced by the guidance reticles of one of the rotating discs as it rotates through five revolutions, in one illustrative reticle pattern example. This chart is not drawn to a correct horizontal time scale.

FIG. 4 shows in a graphical way this complete series of guidance reticle positions. Each rectangular bar in the drawing represents the position of the projected beam during the instant of time it is pulsed through the guidance reticles. The horizontal dimension of this drawing is time, but there is no attempt to construct it in proper scale. The vertical dimension represents height of the projected beam portions through the guidance reticles G1 through G6 of the elevation guidance disc 5. Each light bar is seen to have a height equal to one-half of the total reticle diameter.

Assume that the presence of a light pulse received at the guided projectile is called a "zero", and the absence of a received light pulse is called a "one". Then a guided projectile flying at an elevation distance "g" from the bottom of the beam field, for example only, would receive the guidance code word

000111001111001111001111001111 as shown in FIG. 4. This code word is different from the word it would receive if located at any other elevation position. The bits in this word are obviously read from the signals received at reticle positions RP4, 7, 10, 13, 16 and 19 of the elevation guidance disc 5 during the five revolutions of the cycle. If the guided craft were exactly centered vertically in the beam (on target in the elevation direction) the received location code word would be all zeros, the only position resulting in this reading.

It will be seen from FIG. 3 that all reticle positions beyond RP20 are clear, some of them being used as calibration positions. The remainder can be used for special on-off type signals to direct more than one missile at a time in its flight to different respective targets, so long as the separate targets are all still in the same beam coverage area of course. Although not directly a part of this invention, RP22–24 designated A can be a three-bit binary number giving an address or identification of only one of the plurality of projectiles being guided, to signal it that subsequent reticle positions contain information for the addressed projectile only, for that revolution for example. Reticle position RP26 designated Ae or Aa can signal by a "zero" or a "one" whether the following information is for the elevation or azimuth channel of the projectile flight control system, and RP28–30 and RP32–34 designated B can be plural-bit designations of actual bias signals which instruct the projectile to guide about a point at a certain off-center or biased position of the laser beam 2. Each projectile is then directed to its own individual target whose position is thus relayed through this guidance system from a separate target position designation device.

Reticle positions RP35 and RP36 are considered as unused spares in this system example.

The laser firing controls for either the "on" or "off" pulses for all the clear reticles in the discs are controlled from a pulse format 30 (FIG. 1) governing the firing or no firing of the laser 1 at the various intervals. The timing of the laser pulses is of course basically governed by the trigger timing slots 16 in the disc 6, as described, and by electronic delays in the pulse control 25 for the progressive delayed guidance pulses in every second through fifth revolution of the discs. The synchronizing pulse sent each revolution is advanced slightly in time as produced by the synchronizing slot 17 in one disc.

Referring back to FIG. 1 again, the laser beam 2, after passing through the discs 5 and 6, is projected toward the target(s) by suitable optics 31, depending upon desired characteristics such as range and field of view angle. The optics 31 may include a zoom lens for narrowing the field of view as the projectile distance increases.

Figure 5:
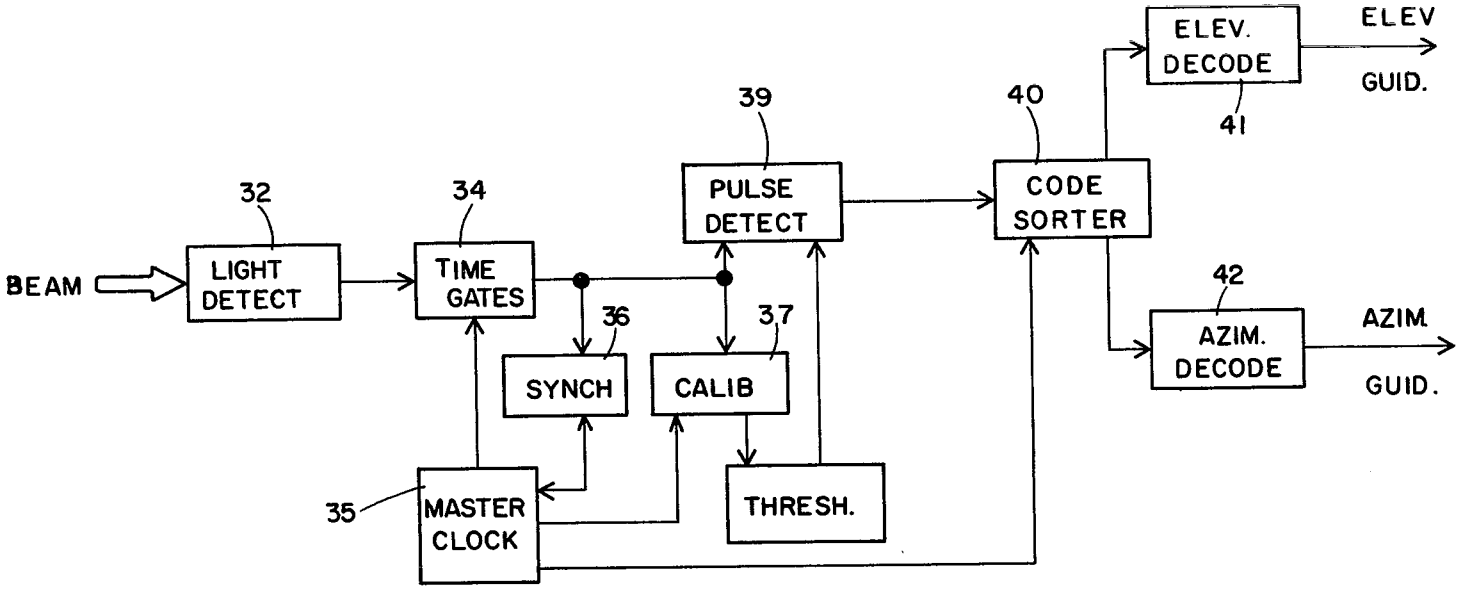
FIG. 5 is a block diagram of a general receiver arrangement for use with the present invention.

For purposes of overall system explanation, the guided missile or vehicle has a receiver as shown broadly in FIG. 5. A signal detector 32 receives the laser beam 2 and translates the light pulses into electrical pulses. Time gates 34 may be used to pass signals only during the time intervals involved in the particular pulse rate employed, so that interference or jamming by outside signals or noise is substantially reduced or eliminated.

A master clock 35 and a synchronizing pulse detector 36 operate the receiver in synchronism with the projector, so that the proper pulse reticle positions can of course be identified. A calibration circuit 37 sets a threshold level using the calibration pulses C as described earlier, so that a pulse detector circuit 39 will accurately distinguish between a "pulse" and "no pulse" in the input. Then a code sorter 40 separates the azimuth and elevation signals, and separate elevation and azimuth decoders 41 and 42 form conventional guidance signals for feeding to a projectile directional control system.

In the particular example as described herein, the laser beam frequency is designed to be 3600 pulses per second and the discs are rotated at 100 revolutions per second. The laser pulse width may be about 1 microsecond. The diameter of each disc 5 and 6 may be about 1.5 inches (38.1 mm) for example. This gives a diameter of each reticle 7 of about 0.1 inch (2.5 mm).

As described, the present example has the total field of view divided into eleven parts by the pattern of guidance reticles G1–G6, and then it is broken down further by using a total of five revolutions of G1–G6 with progressive time delays, to thus enable a location measurement over fifty-nine parts of the field. With this pattern design and the design figures given above, the guidance pulse delay will be about 5.5 microseconds from their nominal pulse position of the previous revolution, for the second through the fifth revolution of each cycle.

The synchronizing pulse may be advanced by about 10 microseconds in time, by advancing the leading edge of the synchronizing slot 17 (FIG. 2). The laser beam 2 from the laser 1 may have a collimating lens 44 or the like to produce a nearly parallel beam at the discs 5 and 6, having a beam diameter which preferably fills the reticles 7 and just a little more. The discs may be about one-eighth inch (3.2 mm) apart.

It is obvious that there are numerous variations and differences which may be made from the presently disclosed embodiment while still keeping the same equivalent invention. The discs 5 and 6 can be rotated in the same direction instead of counter-rotating if one of them is not turned over in relation to the other as illustrated herein. There do not have to be as many calibration pulses as shown herein by the clear spaces C. This would depend to some extent on the amount of atmospheric scintillation expected, and at least one or more calibration pulse per revolution should be provided. The width of the light bar formed by the guidance reticles G1–G6 does not need to be one-half the reticle diameter, but it should be wide enough to provide an unambiguous measurable signal of course. The position of the trigger timing slots 16 can be located at any convenient locations on the disc.

There are many other sequences of elevation and azimuth guidance reticles (and designs thereof) which may be used, as a matter of choice. This of course includes different respective positions within the 36 reticle positions as shown herein, or whatever other number of reticles may be used. It is obvious that all the elevation guidance pulses in one revolution could be projected and then all the azimuth guidance pulses, rather than alternating them as done herein. This would be done, if desired, by indexing the two discs 5 and 6 at a different starting position relative to each other, for example. There are obviously many possibilities for different combinational positions of functions within the total number of recticle spaces.

Figure 6:
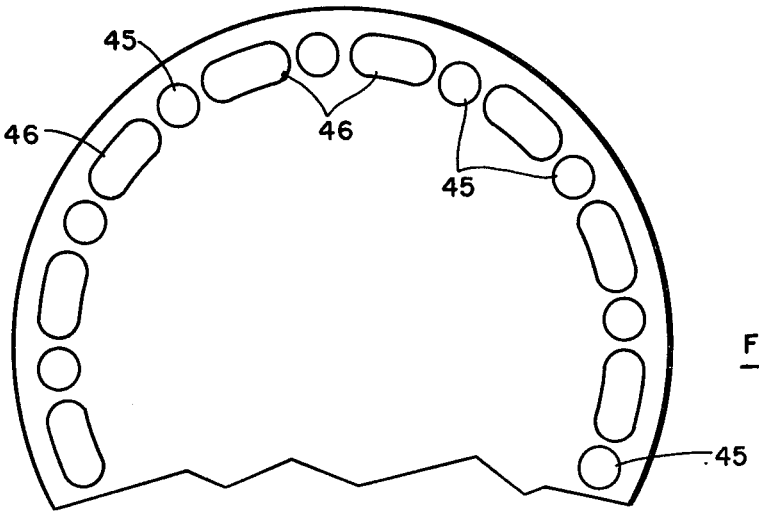
FIG. 6 is a partial view of different form of reticle disc which may be employed, showing one of several possible alternate reticle position constructions.

The shape of the disc reticles 7 for this preferred example has been described as circular. However, it will be observed that with the exception of the six guidance reticles G1–G6, all of the other reticles could be provided by a single empty space, in theory, since the system uses a pulsed laser. Actually, the discs should be of a practical balanced design, but a simpler disc design for the present system might be as shown in FIG. 6, for example, Here, the guidance reticles would be incorporated in some of the circles 45, and the oblong spaces 46 would provide the clear openings at the other reticle positions. This is only one example of many different reticle shapes and design on the discs.

It is also seen that the invention would operate equally as well if the upper portion 11 of guidance reticle G1 in FIG. 2 were light-transmissive instead of light-blocking if at the same time lower portion 12 were light-blocking instead of light-transmissive, and continuing the same reversal of light-transmissive and blocking portions in the remaining guidance reticles. Further, the two control axes need not be horizontal and vertical but they may be perpendicular in any two directions.

While in order to comply with the statute, the invention has been described in language more or less specific as to structural features, it is to be understood that the invention is not limited to the specific features shown, but that the means and construction herein disclosed comprise a preferred mode of putting the invention into effect, and the invention is therefore claimed in any of its forms or modifications within the legitimate and valid scope of the appended claims.

What is claimed is:

1. Beam rider guidance apparatus for a guided object, comprising a light beam generator for projecting a light beam toward a target and onto said object when the latter is launched at said target, a pair of rotating reticle discs in the path of said beam, each of said discs having a series of reticles thereon in a circle centered at the axis of rotation of said disc, one of said discs being an elevation guidance disc having its reticles passing in a vertical direction through said path of said beam, the second disc being an azimuth guidance disc having its reticles passing in a horizontal direction through said beam path, each of said series of reticles comprising a plurality of clear reticles and a plurality of guidance reticles having a light-blocking portion and a light-passing portion wherein said portions are at different positions in each of said guidance reticles to form an advancing pattern circumferentially of its respective disc as said disc is rotated, and means for connecting and driving said discs in a synchronous manner to project said beam through a guidance reticle on said elevation disc and simultaneously through a clear reticle on said azimuth disc, and at different times in said rotation through a clear reticle on said elevation disc and simultaneously through a guidance reticle on said azimuth disc.

2. Apparatus in accordance with claim 1 wherein said light beam generator is a pulsed laser being nominally pulsed once for each passing of a reticle position on said discs.

3. Apparatus in accordance with claim 1 including a circle of trigger timing slots in equally spaced positions on one of said discs, there being one timing slot for one or more said reticles on said one disc, timing slot detecting means mounted adjacent said one disc for detecting the passage of each of said timing slots, and light beam pulse control means connected to the output of said slot detecting means.

4. Apparatus in accordance with claim 3 wherein one of said timing slots is located slightly out of its equally spaced position, for use as a distinguishable synchronizing pulse former once each revolution of said disc.

5. Apparatus in accordance with claim 1 wherein said reticle discs include at least one predetermined calibration reticle position per revolution where a perfectly clear reticle in each disc coincides with the position of said light beam, whereby a full intensity calibration light signal is projected over the entire cross section of said light beam for use by threshold adjusting means.

6. Apparatus in accordance with claim 5 including a plurality of said calibration positions per revolution.

7. Apparatus in accordance with claim 1 wherein said light-passing portion of each of said guidance reticles is of constant width which is substantially half of the diameter of said guidance reticles.

8. A beam rider guidance transmitting system comprising a guidance beam generator, an elevation guidance disc and an azimuth guidance disc rotatably mounted about respective axes fixed parallel to the projected beam from said generator, a plurality of reticles arranged in a circle on each of said discs, said discs being located so that said reticles on said elevation disc intersect said beam in a vertical direction and said reticles on said azimuth disc intersect said beam in a horizontal direction as said discs rotate, said reticles being equally spaced apart such that one said reticle on each said disc is aligned simultaneously on the centerline of said beam during disc rotation, said elevation disc reticles comprising a plurality of elevation guidance reticles and a plurality of clear reticles, said azimuth disc reticles comprising a plurality of azimuth guidance reticles and a plurality of clear reticles, a clear reticle in one said disc always being coincident with a guidance reticle in the other said disc at said beam centerline, and means for rotating said discs in synchronized relation.

9. Apparatus in accordance with claim 8 wherein said guidance reticles each comprise a light-blocking portion and a light-passing portion wherein said portions are at different positions in each of said guidance reticles to form a shifting pattern circumferentially of its respective disc as said disc is rotated.

10. Apparatus in accordance with claim 9 wherein said light-passing portion of each of said guidance reticles is of constant width.

11. Apparatus in accordance with claim 8 wherein said guidance beam is pulsed, and including pulse control means for pulsing said beam "on" each time a guidance reticle is aligned with said beam.

12. Apparatus in accordance with claim 11 including timing means connected to said pulse control means comprising a plurality of timing slots on at least one of said discs, and slot detecting means for detecting the passage of each said timing slot, and further including speed control means for regulating the rotating speed of said discs, said speed control means connected to the output of said slot detecting means.

13. Apparatus in accordance with claim 9 wherein said light-passing portions on each of said guidance discs comprise a series of radial bar-like areas at said different positions spaced substantially equally across the full cross section of said beam in the respective guidance direction.

14. Apparatus in accordance with claim 13 including pulse control means for pulsing said beam on and off, said pulse control means comprising means active during a first revolution of said discs for pulsing said beam "on" each time a guidance reticle is centered on said beam, and means active during a succeeding revolution of said discs for delaying the "on" pulsing of said beam a short constant time allowing each said guidance reticle to advance somewhat further to an advanced position compared to the preceding revolution, there being n number of said succeeding revolutions in a complete cycle before repeating pulsing operation as in said first revolution, the time delays being determined to produce substantially equal spaces between all said advanced positions in said cycle.

15. In a beam rider guidance system having a single guidance beam to be projected at an object being guided in flight, the combination of: a first guidance disc and a second guidance disc rotatably mounted about respective axes positioned parallel to the projected beam, a plurality of reticles arranged in a circle on each of said discs, said discs being located so that said reticles on said first disc intersect said beam in a first direction and said reticles on said second disc intersect said beam in a second direction substantially perpendicular to said first direction as said discs rotate, said reticles on said first disc comprising a plurality of elevation-like guidance reticles and a plurality of clear reticles, said reticles on said second disc comprising a plurality of azimuth-like guidance reticles and a plurality of clear reticles, one of said clear reticles in one said disc always being coaxial with one of said guidance reticles in the other said disc at the centerline of said beam, and means for synchronously rotating said discs.

16. Apparatus in accordance with claim 15 including at least one predetermined calibration reticle position per revolution of said discs wherein a perfectly clear reticle in each said disc coincides with the position of said beam, whereby a full intensity calibration beam signal can be projected over the entire cross section of said beam.

17. Apparatus in accordance with claim 15 including pulse control means for nominally pulsing said beam "on" each time one of said guidance reticles is aligned with the position of said beam.

18. Apparatus in accordance with claim 15 wherein said guidance reticles each comprise a beam-blocking portion and a beam-passing portion, said beam-passing portions on each of said discs comprising a series of radial bar-like areas at different respective positions in each of said guidance reticles spaced substantially equally across the full cross section of said beam in the respective guidance direction, to form a shifting pattern circumferentially of its respective disc as said disc is rotated.

* * * * *